US011497110B2

(12) United States Patent
Sato et al.

(10) Patent No.: US 11,497,110 B2
(45) Date of Patent: Nov. 8, 2022

(54) DIELECTRIC BARRIER DISCHARGE ELECTRODE AND DIELECTRIC BARRIER DISCHARGE DEVICE

(71) Applicants: KABUSHIKI KAISHA TOSHIBA, Tokyo (JP); TOSHIBA ENERGY SYSTEMS & SOLUTIONS CORPORATION, Kawasaki (JP)

(72) Inventors: Yosuke Sato, Kawasaki Kanagawa (JP); Akio Ui, Tokyo (JP); Masato Akita, Kawasaki Kanagawa (JP); Shotaro Oka, Tokyo (JP); Tomonao Takamatsu, Kawasaki Kanagawa (JP); Hiroyuki Yasui, Yokohama Kanagawa (JP); Shinya Matsuda, Kamakura Kanagawa (JP)

(73) Assignees: Kabushiki Kaisha Toshiba, Tokyo (JP); Toshiba Energy Systems & Solutions Corporation, Kawasaki (JP)

( * ) Notice: Subject to any disclaimer, the term of this patent is extended or adjusted under 35 U.S.C. 154(b) by 0 days.

(21) Appl. No.: 17/186,423

(22) Filed: Feb. 26, 2021

(65) Prior Publication Data

US 2022/0087001 A1 Mar. 17, 2022

(30) Foreign Application Priority Data

Sep. 16, 2020 (JP) ..... JP2020-155734

(51) Int. Cl.
*H05H 1/24* (2006.01)

(52) U.S. Cl.
CPC ..... *H05H 1/2406* (2013.01); *H05H 1/2418* (2021.05)

(58) Field of Classification Search
CPC .. H05H 1/2437; H05H 1/2439; H05H 1/2441; H05H 1/2406; H05H 1/2418
See application file for complete search history.

(56) References Cited

U.S. PATENT DOCUMENTS

| | | | | |
|---|---|---|---|---|
| 9,149,551 | B2 | 10/2015 | Takenoshita et al. | |
| 9,934,944 | B2 | 4/2018 | Akita et al. | |
| 2017/0018409 | A1 | 1/2017 | Toshiba | |
| 2022/0053628 | A1* | 2/2022 | Itoh ..... | H05H 1/2439 |

FOREIGN PATENT DOCUMENTS

| | | | |
|---|---|---|---|
| JP | H10-245204 | A | 9/1998 |
| JP | H11-139807 | A | 5/1999 |
| JP | 2003-327419 | A | 11/2003 |
| JP | 2006-222019 | A | 8/2006 |
| JP | 2017-22070 | A | 1/2017 |

* cited by examiner

*Primary Examiner* — Anne M Hines
*Assistant Examiner* — Jose M Diaz
(74) *Attorney, Agent, or Firm* — Finnegan, Henderson, Farabow, Garrett & Dunner, LLP

(57) ABSTRACT

A dielectric barrier discharge electrode of an embodiment has: a dielectric; a first electrode provided to be exposed on the dielectric; a second electrode provided to be covered by the dielectric; and a third electrode provided to be covered by the dielectric in a neighborhood of the first electrode.

15 Claims, 3 Drawing Sheets

DIELECTRIC BARRIER DISCHARGE ELECTRODE AND DIELECTRIC BARRIER DISCHARGE DEVICE

CROSS REFERENCE TO RELATED APPLICATION

This application is based upon and claims the benefit of priority from Japanese Patent Application No. 2020-155734, filed on Sep. 16, 2020; the entire contents of which are incorporated herein by reference.

FIELD

Embodiments described herein relate generally to a dielectric barrier discharge electrode and a dielectric barrier discharge device.

BACKGROUND

As a typical method for generating low-temperature plasma under an atmospheric pressure, a dielectric barrier discharge (DBD) method is known. A discharge device (hereinafter, also referred to as a DBD device) to which the DBD is applied is normally constituted by a pair of electrodes made of metal or the like and a dielectric, and application of a high voltage of several kV to several ten kV, for example, to the pair of electrodes makes discharge (dielectric breakdown) of a gas occur, to generate plasma. Setting a voltage waveform to be an alternating waveform or a pulse waveform enables concentrative acceleration (heating) of only the electrons, so that a temperature of the gas can be suppressed at a level of a room temperature (about 300 K) while an electron temperature becomes as high as about 10000 to 200000 K (about 1 eV to 20 eV, about 11000 K=1 eV). Such a state is referred to as non-equilibrium plasma or low-temperature plasma.

The DBD device generally has a constitution in which at least a part of the electrodes is covered by the dielectric. Such a constitution can prevent flowing of excessive current due to short circuit, to thereby enhance safety or controllability of the DBD device, enabling application of the DBD device to a broad range of fields. Regarding the DBD device as above, though safety is improved by performing discharge while the dielectric (insulator) is sandwiched between the electrodes, there is a problem of a high operating voltage. As a measure to drive a DBD device at a low voltage, it is studied to thin a dielectric disposed between electrodes, to use a material having a high relative dielectric constant, and so on. However, thinning of the dielectric or the like causes deterioration or decomposition of surfaces of the dielectric and the metal electrode which are directly exposed to discharge, leading to a problem of decreasing durability or operating life of the DBD electrode and the DBD device.

DETAILED DESCRIPTION

A dielectric barrier discharge electrode of an embodiment has a dielectric, a first electrode provided to be exposed on a surface of the dielectric, a second electrode provided to be covered by the dielectric, and a third electrode provided to be covered by the dielectric in a neighborhood of the first electrode.

Hereinafter, a dielectric barrier discharge electrode and a dielectric barrier discharge device of the embodiment will be described with reference to the drawings. Note that in respective embodiments substantially the same constituent parts are denoted by the same reference signs and description thereof may be partially omitted. The drawings are schematic, and a relation between a thickness and a planar dimension of each part, a thickness ratio among parts, and so on may be different from actual ones.

First Embodiments

Figure 1:
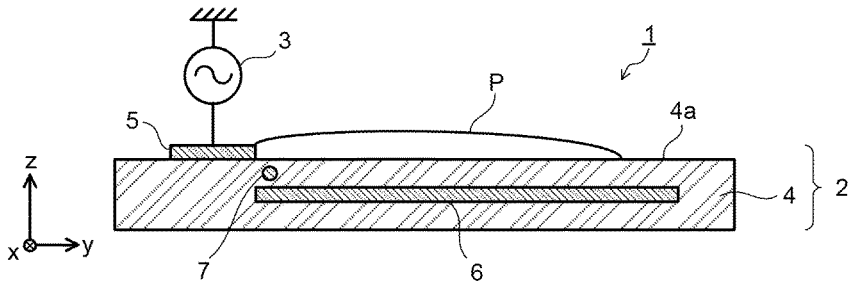
FIG. 1 is a cross-sectional view illustrating a dielectric barrier discharge device of a first embodiment.
Figure 2:
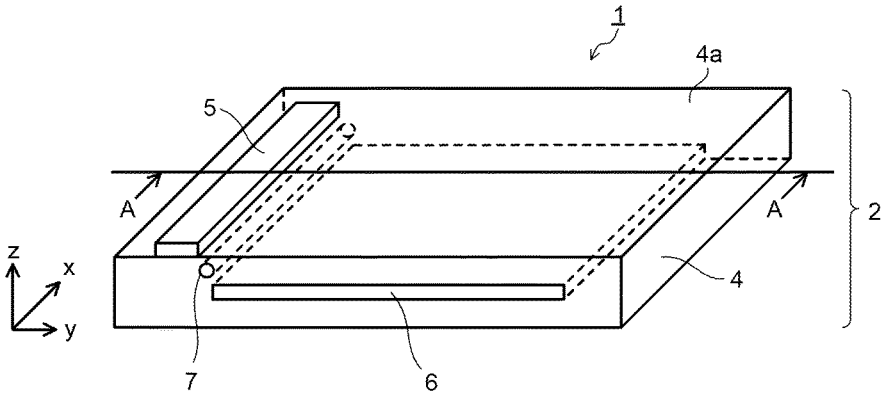
FIG. 2 is a perspective view of the dielectric barrier discharge device illustrated in FIG. 1.

FIG. 1 is a cross-sectional view illustrating a dielectric barrier discharge device of a first embodiment, and FIG. 2 is a perspective view illustrating the dielectric barrier discharge device of the first embodiment. FIG. 1 is the cross-sectional view taken along a line A-A of FIG. 2. The dielectric barrier discharge device 1 illustrated in FIG. 1 and FIG. 2 has a dielectric barrier discharge electrode 2 and a power supply 3 which applies a voltage to the dielectric barrier discharge electrode 2. The dielectric barrier discharge electrode 2 has a flat plate-shaped dielectric 4, a first electrode 5, a second electrode 6, and a third electrode 7. The power supply 3 is electrically connected to the first electrode 5. By applying a voltage from the power supply 3 to the first electrode 5, discharge (dielectric breakdown) occurs to thereby generate plasma. The second electrode 6 is basically grounded (0 V). The third electrode 7 is not necessarily required to be grounded but is preferable to be grounded.

In the dielectric barrier discharge electrode 2, the first electrode 5 is provided on a surface 4*a* of the dielectric 4 and has a plate shape, a foil shape, or the like. Here, two directions parallel to the surface 4*a* of the dielectric 4 and orthogonal to each other are defined as an x-direction (first direction) and a y-direction (second direction), and a direction orthogonal to the x-direction and the y-direction is defined as a z-direction (third direction). The first electrode 5 is exposed on the dielectric 4 and extends in the x-direction. The second electrode 6 and the third electrode 7 are provided inside the dielectric 4 and covered by the dielectric 4. The second electrode 6 extends in the x-direction and the y-direction, and the third electrode 7 extends in the x-direction. The first electrode 5, the second electrode 6, and the third electrode 7 are insulated one another by the dielectric 4. The third electrode 7 is a starting point of discharge between the third electrode 7 and the first electrode 5 and generates plasma. The second electrode 6 expands a generation area of the plasma generated by the third electrode 7 in the y-direction along the surface 4*a* of the dielectric 4.

For the dielectric 4, for example, there is used a glass material such as non-alkali glass or borosilicate glass, a ceramic material such as alumina ceramics or silicon nitride ceramics, a resin material such as epoxy resin or polyether resin, or the like. For the first electrode 5, the second electrode 6, and the third electrode 7, there is used a metal material such as copper, silver, chromium, titanium, or platinum, for example. As a waveform of the voltage applied to the first electrode 5, an alternating waveform or a pulse waveform is used. As a frequency of an alternating current, a frequency of several Hz to several GHz can be used. The frequency of the alternating current is typically several kHz to several MHz, and it is possible to use a microwave of GHz order. A commercial power supply frequency (50 or 60 Hz) is also usable. As the pulse waveform, a waveform having a risetime of several nanoseconds to several hundred microseconds can be used.

When a voltage is applied to the first electrode 5 provided in a state of being exposed on the dielectric 4 as described above, dielectric breakdown occurs between the covered electrode provided inside the dielectric 4 and the first electrode 5 to thereby generate plasma. In order to make discharge likely to occur between the first electrode 5 and the covered electrode, decreasing a distance between the first electrode 5 and the covered electrode is effective. Thus, in a case where only a second electrode 6 is disposed inside a dielectric 4, by decreasing a distance from a surface 4*a* of the dielectric 4 to the second electrode 6, discharge becomes likely to occur, so that a discharge voltage can be lowered. However, by decreasing the distance from the surface 4*a* of the dielectric 4 to the second electrode 6 and thinning the dielectric 4 on the second electrode 6, deterioration, shaving (digging), or the like of the dielectric 4 becomes likely to occur when plasma is generated. Further, the second electrode 6 itself becomes likely to be deteriorated or decomposed. These are causes to decrease durability of a dielectric barrier discharge electrode.

Figure 3:
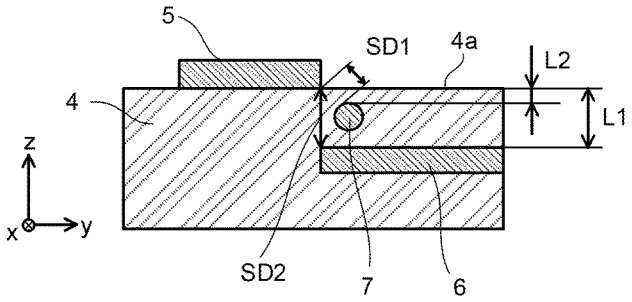
FIG. 3 is a cross-sectional view enlargedly illustrating a part of the dielectric barrier discharge device illustrated in FIG. 1.

In contrast, in the dielectric barrier discharge electrode 2 of the first embodiment, the second electrode 6 is disposed at a position inside the dielectric 4 which enables increasing durability of the dielectric 4 and the second electrode 2, and additionally, the third electrode 7 is disposed in the neighborhood of the first electrode 5 inside the dielectric 4. A position at which the third electrode 7 is disposed is preferable to be a position making a shortest distance SD1 between the first electrode 5 and the third electrode 7 shorter than a shortest distance SD2 between the first electrode 5 and the second electrode 6, as illustrated in FIG. 3. By using the third electrode 7 whose distance to the first electrode 5 is short, an electric field becomes locally high between the first electrode 5 and the third electrode 7, so that first discharge (ignition) is accelerated to enable driving at a low voltage.

When the discharge between the first electrode 5 and the third electrode 7 is accelerated and plasma P is generated, the plasma P develops in the y-direction along the surface 4*a* of the dielectric 4 by the second electrode 6 provided inside the dielectric 4, so that it is possible to broaden a forming region of the plasma P and suppress concentration of discharge in a neighborhood of the third electrode 7. Therefore, it is possible to generate plasma P at a low voltage while suppressing deterioration or shaving of the dielectric 4 due to thinning, and further, deterioration or decomposition of the second electrode 6 and the third electrode 7. In other words, it is possible to enhance formability of the plasma P at the low voltage and additionally improve durability of the dielectric barrier discharge electrode 2.

As described above, in order to realize acceleration of discharge by the third electrode 7 as well as improvement of durability of the dielectric 4 and expansion of the plasma P by the second electrode 6, it is preferable to dispose the second electrode 6 and the third electrode 7 in a manner that a distance L2 from the surface 4*a* of the dielectric 4 to the third electrode 7 in the z-direction is shorter than a distance L1 from the surface 4*a* of the dielectric 4 to the second electrode 6 in the z-direction, as illustrated in FIG. 3. The distance L1 is preferably 5 mm or more and the distance L2 is preferably less than 5 mm. By disposing the second electrode 6 in a manner that the distance L1 is 5 mm or more and 20 mm or less, it is possible to improve sustainability and expandability of the plasma P while enhancing durability of the dielectric 4. The distance L2 is preferably 1 mm or more and 5 mm or less, more preferably 3 mm or less, in order to suppress short circuit or the like between the first electrode 5 and the third electrode 7 while accelerating discharge.

The second electrode 6 is provided to extend in the x-direction and the y-direction, as described above. The second electrode 6 preferably has a plate shape or a foil shape of 10 μm or more and 2 mm or less in thickness (dimension in z-direction), for example. A length in the x-direction of the second electrode 6 is preferably 5 mm or more and the length in the x-direction and a length in the y-direction of the second electrode 6 are preferably set so that an aspect ratio of the length in the y-direction to the length in the x-direction may be five or more. Thereby, development and expandability of the plasma P can be enhanced. Further, since it suffices that the third electrode 7 becomes a starting point of discharge, the third electrode 7 may have a wire shape or a bar shape, for example. It suffices that the first electrode 5 has a thickness which can withstand a voltage applied by the power supply 3 and a length which can realize expansion of the plasma P in the x-direction.

Second Embodiment

Figure 4:
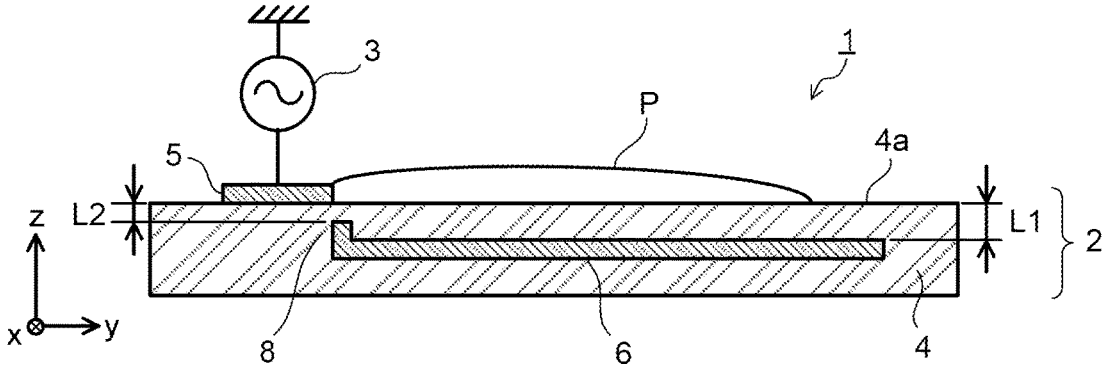
FIG. 4 is a cross-sectional view illustrating a dielectric barrier discharge device of a second embodiment.
Figure 5:
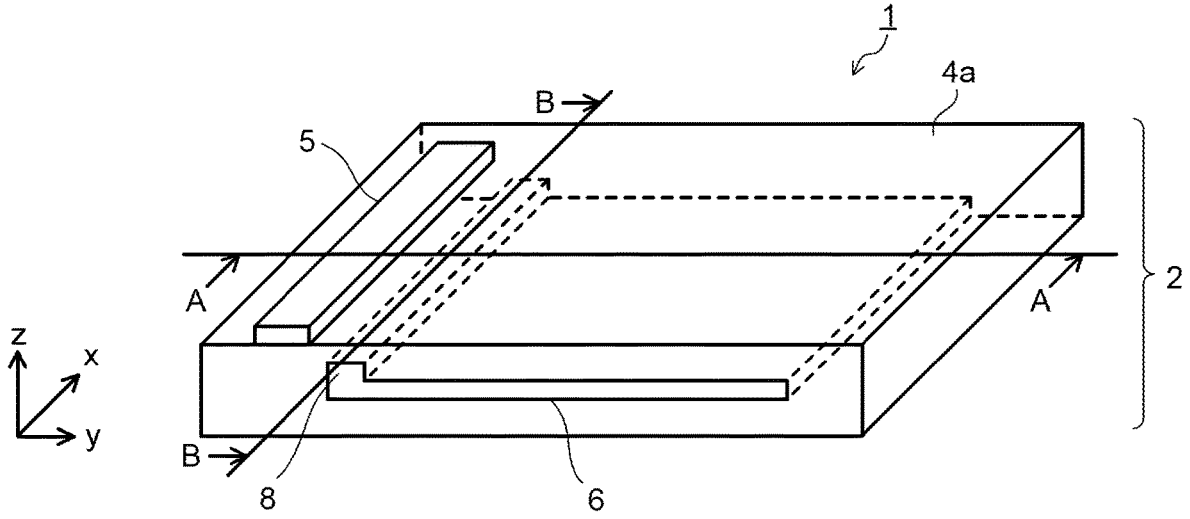
FIG. 5 is a perspective view of the dielectric barrier discharge device illustrated in FIG. 4.
Figure 6:
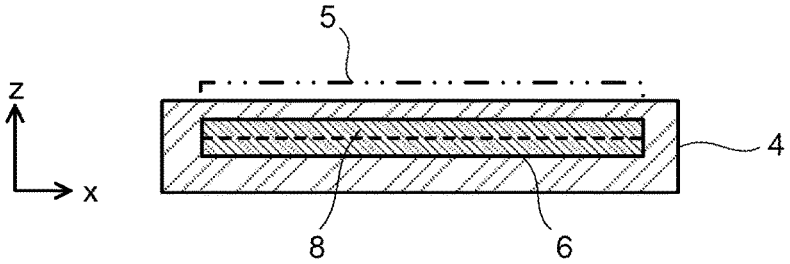
FIG. 6 is another cross-sectional view of the dielectric barrier discharge device illustrated in FIG. 4.

Next, a dielectric barrier discharge electrode and a dielectric barrier discharge device of a second embodiment will be described with reference to FIG. 4 to FIG. 7. FIG. 4 is a cross-sectional view illustrating the dielectric barrier discharge device of the second embodiment, FIG. 5 is a perspective view illustrating the dielectric barrier discharge device of the second embodiment, and FIG. 6 is a cross-sectional view illustrating the dielectric barrier discharge device of the second embodiment. FIG. 4 is the cross-sectional view taken along a line A-A of FIG. 5, and FIG. 6 is the cross-sectional view taken along a line B-B of FIG. 5. The dielectric barrier discharge device 1 illustrated in FIG. 4, FIG. 5, and FIG. 6 has a dielectric barrier discharge electrode 2 and a power supply 3 which applies a voltage to the dielectric barrier discharge electrode 2, similarly to in the first embodiment. The dielectric barrier discharge electrode 2 of the second embodiment is different from the dielectric barrier discharge electrode 2 of the first embodiment in that a structure of a second electrode 6 is different and in that a third electrode does not exist. Other than the above, the dielectric barrier discharge electrode 2 of the second embodiment has a constitution similar to that of the dielectric barrier discharge electrode 2 of the first embodiment.

The dielectric barrier discharge electrode 2 of the second embodiment does not have the third electrode 7, and instead, the second electrode 6 has a projecting portion 8. The second electrode 6 extends in an x-direction and a y-direction, similarly to in the first embodiment. In addition to such a shape, the second electrode 6 has the projecting portion 8 provided in an end portion on a first electrode 5 side. The projecting portion 8 has a shape projecting in a z-direction toward the first electrode 5. The projecting portion 8 provided to decrease a distance from the second electrode 6 to the first electrode 5 functions similarly to the third electrode 7 of the first embodiment.

The projecting portion 8 of the second electrode 6 is disposed in a manner that a distance from a surface 4*a* of a dielectric 4 is similar to the case of the third electrode 7 of the first embodiment. A main body portion of the second embodiment 6 is disposed similarly to the second electrode 6 of the first embodiment. Concretely, the projecting portion 8 of the second electrode 6 is preferably disposed inside the dielectric 4 in a manner that the distance (L2) from the surface 4*a* of the dielectric 4 is less than 5 mm similarly to the third electrode 7 of the first embodiment. The distance (L2) is more preferably 3 mm or less. The main body portion other than the projecting portion 8 of the second electrode 6 is preferably disposed inside the dielectric 4 in a manner that a distance (L1) from the surface 4*a* of the dielectric 4 is 5 mm or more, similarly to the second electrode 6 of the first embodiment. The distance (L2) of the projecting portion 8 and the distance (L1) of the main body portion of the second electrode 6 are preferably set similar to those of the first embodiment.

According to the dielectric barrier discharge electrode 2 of the second embodiment, an electric field becomes locally high between the first electrode 5 and the projecting portion 8, so that first discharge (ignition) is accelerated to enable driving at a low voltage. When the discharge between the first electrode 5 and the projecting portion 8 is accelerated and plasma P is generated, the plasma P develops in the y-direction along the surface 4*a* of the dielectric 4 by the main body portion of the second electrode 6 provided inside the dielectric 4, so that it is possible to broaden a forming region of the plasma P and suppress concentration of discharge in a neighborhood of the projecting portion 8. Therefore, it is possible to generate plasma P at a low voltage while suppressing deterioration or shaving of the dielectric 4 due to thinning, and further, deterioration or decomposition of the second electrode 6. In other words, it becomes possible to enhance formability of the plasma P at the low voltage and additionally improve durability of the dielectric barrier discharge electrode 2.

Figure 7:
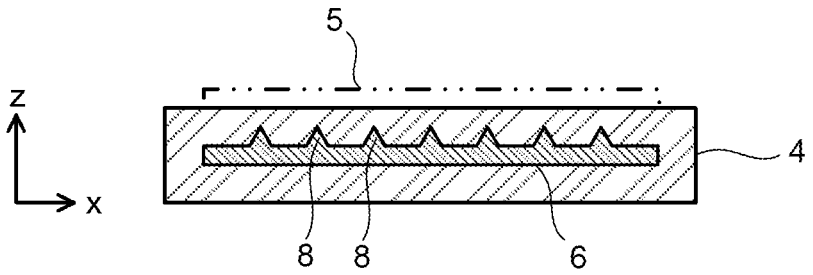
FIG. 7 is a cross-sectional view illustrating a modification example of the dielectric barrier discharge device of the second embodiment.

In FIG. 4 to FIG. 6, the second electrode 6 having the projecting portion 8 extending continuously in the x-direction is illustrated, but the projecting 8 is not limited to the above. For example, as illustrated in FIG. 7, a second electrode 6 may have a plurality of projecting portions 8 provided separately in an x-direction. The plurality of projecting portions 8 having such a shape can also bring about an effect similar to that of the projecting portion 8 extending continuously in the x-direction. In other words, first discharge (ignition) is accelerated between a first electrode 5 and the plurality of projecting portions 8 to thereby enable driving at a low voltage. A shape of the projecting portion illustrated in FIG. 7 is not limited to a shape of a pyramid, a circular cone, or the like which has a sharp tip, but may be a hemisphere, a circular cylinder, a prism, or the like.

Third Embodiment

Figure 8:
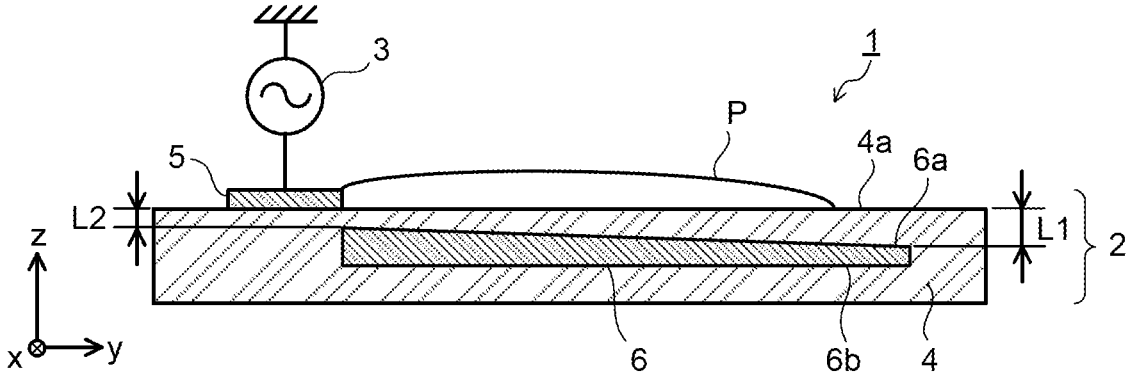
FIG. 8 is a cross-sectional view illustrating a first example of a dielectric barrier discharge device of a third embodiment.
Figure 9:
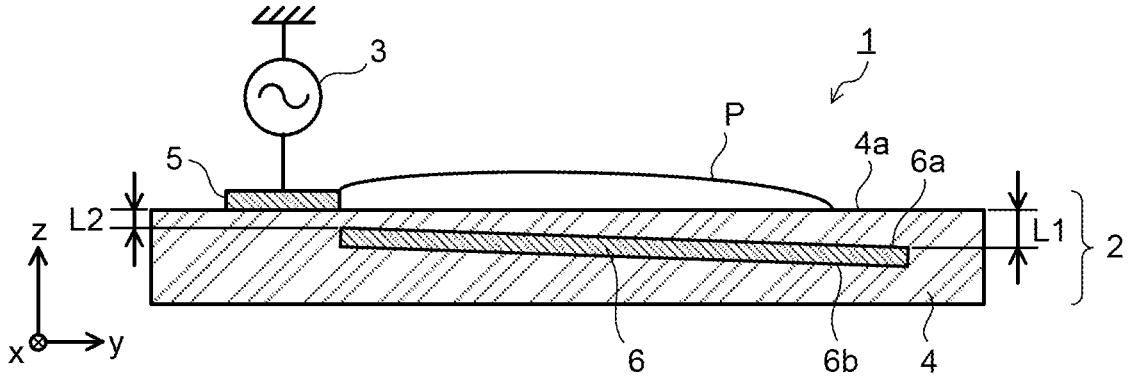
FIG. 9 is a cross-sectional view illustrating a second example of the dielectric barrier discharge device of the third embodiment.

Next, a dielectric barrier discharge electrode and a dielectric barrier discharge device of a third embodiment will be described with reference to FIG. 8 and FIG. 9. FIG. 8 is a cross-sectional view illustrating a first example of the dielectric barrier discharge device of the third embodiment, and FIG. 9 is a cross-sectional view illustrating a second example of the dielectric barrier discharge device of the third embodiment. The dielectric barrier discharge device 1 illustrated in FIG. 8 and FIG. 9 has a dielectric barrier discharge electrode 2 and a power supply 3 which applies a voltage to the dielectric barrier discharge electrode 2, similarly to in the second embodiment. The dielectric barrier discharge electrode 2 of the third embodiment is different from the dielectric barrier discharge electrode 2 of the second embodiment in that a structure of a second electrode 6 is different. Other than the above, the dielectric barrier discharge electrode 2 of the third embodiment has a similar constitution to that of the dielectric barrier discharge electrode 2 of the second embodiment.

In the dielectric barrier discharge electrode 2 of the third embodiment, a first surface 6*a* of the second electrode 2 on a surface 4*a* side of a dielectric 4 is inclinedly disposed inside the dielectric 4, in place of the projecting portion 8 provided in the second electrode 6 of the second embodiment. The second electrode 6 has a first end portion on a first electrode 5 side and a second end portion being the other end portion in a y-direction. The second electrode 6 is disposed inside the dielectric 4 in a state where the first surface 6*a* is inclined in a manner that a first distance from the surface 4*a* of the dielectric 4 to the first end portion is shorter than a second distance from the surface 4*a* of the dielectric 4 to the second end portion.

The second electrodes 6 illustrated in FIG. 8 and FIG. 9 each have the first surface 6*a* where the first distance is shorter than the second distance. In the second electrode 6 illustrated in FIG. 8, a second surface 6*b* on a side opposite to the first surface 6*a* is parallel to the surface 4*a* of the dielectric 4. In the second electrode 6 illustrated in FIG. 9, a second surface 6*b* on a side opposite to the first surface 6*a* is parallel to the first surface 6*a*. In making the first distance of the second electrode 6 shorter than the second distance, a shape may be such that only the first surface 6*a* is inclined in relation to the dielectric 4 as illustrated in FIG. 8 or that the entire second electrode 6 is inclined in relation to the dielectric 4 as illustrated in FIG. 9. The second electrode 6 illustrated in FIG. 8 has a rectangular shape deformed in a manner that the first surface 6*a* is inclined. The second electrode 6 illustrated in FIG. 9 has a common rectangular shape, and such a second electrode 6 is inclinedly disposed inside the dielectric 4.

In the second electrode 6 of the third embodiment, the first end portion is preferably disposed inside the dielectric 4 in a manner that a distance (L2) from the surface 4*a* of the dielectric 4 is less than 5 mm similarly to the case of the third electrode 7 of the first embodiment. The distance (L2) is more preferably 3 mm or less. The second end portion is preferably disposed inside the dielectric 4 in a manner that a distance (L1) from the surface 4*a* of the dielectric 4 is 5 mm or more similarly to the case of the second electrode 6 of the first embodiment. The distance (L2) of the first end portion and the distance (L1) of the second end portion are preferably set similarly to the distance L1 and the distance L2 of the first embodiment. By the inclined disposition of the second electrode 6, an effect similar to that of the second embodiment can be obtained.

In other words, according to the dielectric barrier discharge electrode 2 of the third embodiment, an electric field becomes locally high between the first electrode 5 and the first end portion of the second electrode 6, so that first discharge (ignition) is accelerated to enable driving at a low voltage. When the discharge between the first electrode 5 and the first end portion of the second electrode 6 is accelerated and plasma P is generated, the plasma P develops in the y-direction along the surface 4*a* of the dielectric 4 by the second electrode 6 provided inside the dielectric 4, so that it is possible to broaden a forming region of the plasma P and suppress concentration of discharge in the first end portion. At this time, the second electrode 6 is inclinedly disposed and the distance from the surface 4*a* of the dielectric 4 to the second electrode 6 is gradually increased toward the second end portion, so that deterioration of the dielectric 4 or the second electrode 6 can be suppressed. Therefore, it is possible to generate plasma P at a low voltage while suppressing deterioration or shaving of the dielectric 4 due to general thinning, and further, deterioration or decomposition of the second electrode 6. In other words, it is possible to enhance formability of the plasma P at the low voltage, and additionally, improve durability of the dielectric barrier discharge electrode 2.

In FIG. 8 and FIG. 9, the second electrode 6 with the planar first surface 6*a* is illustrated, but the second electrode 6 is not limited to the above. For example, a second electrode 6 may have a first surface 6*a* which is made to become lower in a staircase pattern from a first end portion toward a second end portion. In such a case, in place of the second electrode 6 illustrated in FIG. 8, it is possible to apply the first surface 6*a* formed in the staircase pattern in a manner that a distance from a surface 4*a* of a dielectric 4 becomes large in stages from the first end portion toward the second end portion. The second electrode 6 with the first surface 6 of the aforementioned shape can also accelerate first discharge (ignition) between the first electrode 5 and the first end portion of the second electrode 6 to thereby generate plasma at a low voltage.

While certain embodiments of the present invention have been described, these embodiments have been presented by way of example only, and are not intended to limit the scope of the inventions. The novel embodiments described herein may be embodied in a variety of other forms; furthermore, various omissions, substitutions and changes may be made therein without departing from the spirit of the inventions. The accompanying claims and their equivalents are intended to cover such forms or modifications as would fall within the scope and spirit of the inventions.

What is claimed is:

1. A dielectric barrier discharge electrode comprising:
a dielectric;
a first electrode provided to be exposed on a surface of the dielectric;
a second electrode provided to be covered by the dielectric; and
a third electrode provided to be covered by the dielectric in a neighborhood of the first electrode, wherein
the third electrode is disposed in a manner that a distance from the surface of the dielectric in a third direction orthogonal to a first direction and a second direction which are parallel to the surface of the dielectric is shorter than a distance from the surface of the dielectric to the second electrode in the third direction,
the second electrode is disposed inside the dielectric in a manner that the distance from the surface of the dielectric in the third direction is 5 mm or more, and
the third electrode is disposed inside the dielectric in a manner that the distance from the surface of the dielectric in the third direction is less than 5 mm.

2. The electrode according to claim 1, wherein
the third electrode is disposed in a manner that a shortest distance between the first electrode and the third electrode is shorter than a shortest distance between the first electrode and the second electrode.

3. The electrode according to claim 1, wherein
the first electrode extends in the first,
the second electrode extends in the first direction and the second direction; and
the third electrode extends in the first direction.

4. A dielectric barrier discharge device comprising:
the dielectric barrier discharge electrode according to claim 1; and
a power supply electrically connected at least to the first electrode of the dielectric barrier discharge electrode.

5. A dielectric barrier discharge electrode comprising:
a dielectric;
a first electrode provided to be exposed on a surface of the dielectric;
a second electrode provided to be covered by the dielectric; and
a third electrode provided to be covered by the dielectric in a neighborhood of the first electrode, wherein
the third electrode is disposed in a manner that a distance from the surface of the dielectric in a third direction orthogonal to a first direction and a second direction which are parallel to the surface of the dielectric is shorter than a distance from the surface of the dielectric to the second electrode in the third direction, and
the second electrode has a shape in which a length in the first direction is 5 mm or more and an aspect ratio of a length in the second direction to the length in the first direction is five or more.

6. A dielectric barrier discharge device comprising:
the dielectric barrier discharge electrode according to claim 5; and
a power supply electrically connected at least to the first electrode of the dielectric barrier discharge electrode.

7. A dielectric barrier discharge electrode comprising:
a dielectric;
a first electrode provided to be exposed on a surface of the dielectric; and
a second electrode provided to be covered by the dielectric, wherein
the second electrode includes an end portion and a projecting portion which is provided in the end portion on a side of the first electrode and is projected toward the first electrode,
the first electrode extends in a first direction parallel to the surface of the dielectric,
the second electrode has a main body portion extending in the first direction and a second direction parallel to the surface and orthogonal to the first direction, and the projecting portion projecting in a third direction orthogonal to the first direction and the second direction,
the projecting portion of the second electrode is disposed inside the dielectric in a manner that a distance from the surface of the dielectric in the third direction is less than 5 mm, and
the main body portion of the second electrode is disposed inside the dielectric in a manner that a distance from the surface of the dielectric in the third direction is 5 mm or more.

8. The electrode according to claim 7, wherein the projecting portion of the second electrode extends in the first direction.

9. The electrode according to claim 7, wherein the second electrode has a plurality of the projecting portions provided separately in the first direction.

10. A dielectric barrier discharge device comprising:

the dielectric barrier discharge electrode according to claim 7; and a power supply electrically connected at least to the first electrode of the dielectric barrier discharge electrode.

11. A dielectric barrier discharge electrode comprising:

a dielectric;

a first electrode provided to be exposed on a surface of the dielectric; and a second electrode provided to be covered by the dielectric, wherein the first electrode extends in a first direction parallel to the surface of the dielectric, and the second electrode extends in a second direction parallel to the surface of the dielectric and orthogonal to the first direction and is disposed inside the dielectric in a manner that, in a third direction orthogonal to the first direction and the second direction, a first distance from one end portion on a side of the first electrode to the surface of the dielectric is shorter than a second distance from the other end portion to the surface of the dielectric, and the second electrode is disposed inside the dielectric in a manner that the first distance is less than 5 mm and the second distance is 5 mm or more.

12. The electrode according to claim 11, wherein the second electrode has a first surface where the first distance is shorter than the second distance.

13. The electrode according to claim 12, wherein the second electrode has a second surface parallel to the surface of the dielectric.

14. The electrode according to claim 12, wherein the second electrode has a second surface parallel to the first surface.

15. A dielectric barrier discharge device comprising:

the dielectric barrier discharge electrode according to claim 11; and a power supply electrically connected at least to the first electrode of the dielectric barrier discharge electrode.

* * * * *